United States Patent [19]

Gisewsky

[11] 4,431,242

[45] Feb. 14, 1984

[54] SELF-CLEANING CONNECTOR

[76] Inventor: Karl R. Gisewsky, 75 Ascheberger St., D2320 Plön, Fed. Rep. of Germany

[21] Appl. No.: 310,389

[22] Filed: Oct. 13, 1981

[51] Int. Cl.[3] ..... H01R 25/02; H01R 11/22

[52] U.S. Cl. ..... 339/48; 339/255 R

[58] Field of Search ..... 339/48, 49 B, 95 R, 339/95 A, 255 R

[56] References Cited

U.S. PATENT DOCUMENTS

| | | | |
|---|---|---|---|
| 513,949 | 1/1894 | Munson | 339/255 R |
| 3,805,006 | 4/1974 | Clark | 339/255 R |
| 4,014,600 | 3/1977 | Gisewsky | 339/48 |
| 4,078,848 | 3/1978 | Blairsdale | 339/255 R |

*Primary Examiner*—Joseph H. McGlynn
*Assistant Examiner*—Paula Austin
*Attorney, Agent, or Firm*—Jack W. Hayden

[57] ABSTRACT

This invention relates to a seismic electric connector assembly which comprises a pair of cooperable plug members. The connector carries a plurality of engageable male and female electric contacts in opposed end faces of the plug members. The contacts are embedded in a resilient, elastic insulator base. The base of each concave contact surface is provided with a linear groove for accepting minute dirt particles therein. Each contact is made up of a head and of a rod frictionally engaged therewith, and a coil spring is mounted on each rod.

1 Claim, 8 Drawing Figures

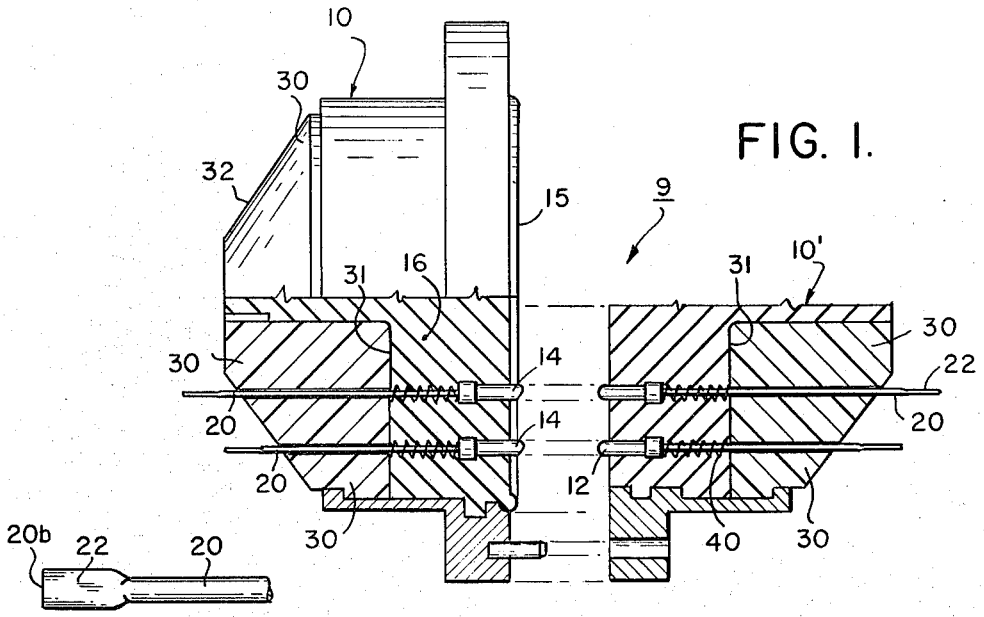
FIG. 1.
FIG. 3.
FIG. 4.
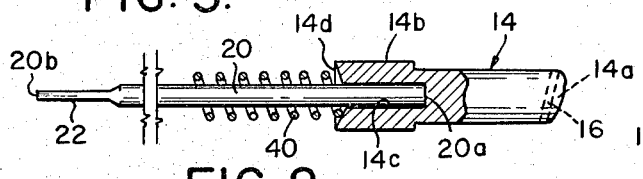
FIG. 2.
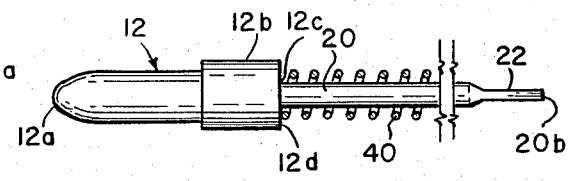
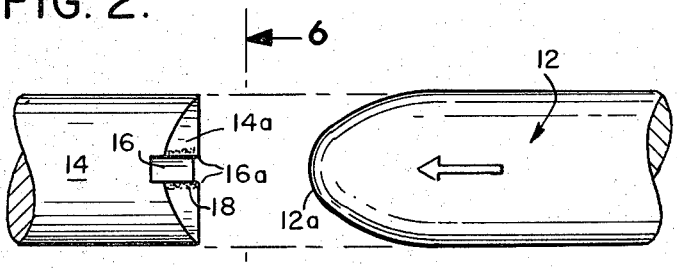
FIG. 5.
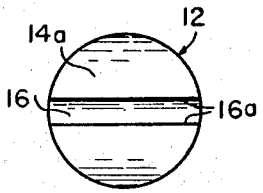
FIG. 6.
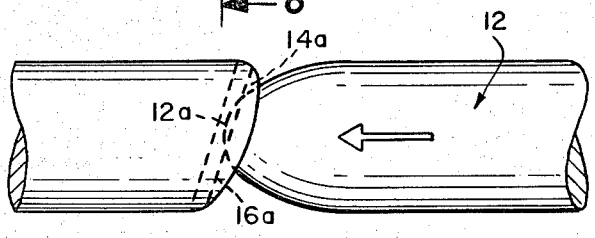
FIG. 7.
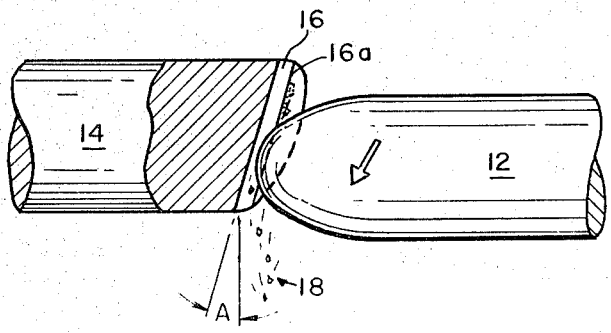
FIG. 8.

SELF-CLEANING CONNECTOR

BACKGROUND OF THE INVENTION

1. Field of the Invention

This invention is an improvement on the seismic connector disclosed in my U.S. Pat. No. 4,014,600, which is incorporated herein by reference.

2. Description of the Prior Art

In my said U.S. patent, I show a seismic electric connector assembly which comprises a pair of cooperable plug members, each having an elastic insulator base for carrying a plurality of engageable male and female electric contacts in opposed end faces of the plug members. Each male contact has a convex surface and each mating female contact has a concave surface. The base of the concave surface is inclined at an acute angle relative to a plane perpendicular to the longitudinal axis of the contact, i.e., relative to a plane perpendicular to the direction of contact pressure.

When the convex and concave contact surfaces first touch each other, there is no misalignment between the axes of the male and female contacts. When the plug members are further moved into mating engagement with each other, pressure between the mating convex and concave contact surfaces is increased. The inclination of the concave contact surface causes the male contact to shift laterally. This displacement produces a desired wiping action which is essential to clean dirt, sand, oxides or other foreign particles from the contact surfaces.

This wiping lateral movement is possible since the base containing the contacts is elastically resilient. With this wiping motion, most dirt particles are pushed to one side and finally fall out of the concave contact surface. At the same time, the mating convex and concave contact surfaces wipe each other.

It is an object of the present invention to improve on the self-cleaning ability of the mating contact surfaces.

It is another object of the invention to increase the contact pressure between the mating contact surfaces as the plug members are moved into mating engagement with each other, and simultaneously mechanically isolate the contacts against their tendency to follow the motion of each other.

It is a further object of the invention to reduce the cost of manufacturing the male and female contacts and at the same time increase their structural stability without reducing their conductivity characteristics.

SUMMARY OF THE INVENTION

This invention relates to a seismic electric connector assembly which comprises a pair of cooperable plug members. The connector carries a plurality of engageable male and female electric contacts in opposed end faces of the plug members. The contacts are embedded in a resilient, elastic insulator base which permits slight lateral and axial movements of the contacts. Each male contact has a convex contact surface and each female contact has a concave contact surface which is inclined at an acute angle from a perpendicular to the direction of contact pressure.

In accordance with the invention, the base of each concave contact surface is provided with a linear groove for accepting minute dirt particles therein, thereby minimizing any tendency for the dirt particles to build up an insulating film which might break the conductivity between the mating contact surfaces.

Also, the edges of this groove will assist in cleaning the convex contact surface.

Each contact consists of a cylindrical contact head defining at its outer end its contact surface and at its inner end a coaxial bore for accepting therein a stiff conductor rod. The dimensions of the bore and of the rod are such as to provide a frictional engagement therebetween.

The resilient base in each plug is mounted on a rigid support member. A coil spring is disposed on each rod between the contact head and the rigid support member.

BRIEF DESCRIPTION OF THE DRAWINGS

FIG. 1 is a side view, partly in section, of the improved connector of this invention;

FIG. 2 shows a fully assembled female contact;

FIG. 3 shows the outer end of each contact;

FIG. 4 shows a fully assembled male contact;

FIG. 5 shows the male and female contact surfaces as they move for mating engagement;

FIG. 6 is a plan view taken on line 6—6 of FIG. 5;

FIG. 7 illustrates the positions of the contact surfaces at the start of their mating engagement; and FIG. 8 illustrates the relative lateral displacement of the contact surfaces resulting from an increase in contact pressure therebetween.

DESCRIPTION OF THE PREFERRED EMBODIMENTS

With reference to the drawings, there is shown a modified connector plug of the general type disclosed in my said U.S. Pat. No. 4,014,600. Only the modifications brought about will be described herein in detail. For a full understanding of the structure of the connector reference should be had to my said patent.

The connector, generally designated as 9, has a pair of plugs 10–10' (FIG. 1). Plug 10 carries a plurality of engageable male contacts 12 and female contacts 14 in opposed end faces 15 of the plug members. The male and female contacts are embedded in an elastically resilient insulator base 16 which permits slight axial and lateral movements between the contacts.

Each male contact assembly 12 has a convex contact surface 12*a* at one end of a contact head 12*b*. At the opposite end of the head 12*b* is defined an axial bore 12*c* extending inwardly from the center of the bottom face 12*d*.

The female contact assembly 14 is similarly constructed. It has a head 14*b* defining at one end a concave contact surface 14*a* which is inclined at an angle A (FIG. 8) deviating from a perpendicular to the direction of contact pressure, as described and claimed in my said patent. The other end of head 14*b* has an axial bore 14*c*, and a bottom face 14*d*.

In use, when the convex and concave contact surfaces (12*a*, 14*a*) first touch each other (FIG. 7), there is no misalignment between the longitudinal axes of the male and female contacts (12, 14).

When the contact surfaces are further moved into mating engagement with each other (FIG. 8), pressure therebetween is increased causing a relative lateral displacement between their axes in the direction of the arrow. This displacement produces a desired wiping action to clean off from the contact surfaces (12*a*, 14*a*) minute dirt particles 18, which are pushed to one side of the concave contact surface 14*a*. Finally, most of the dirt particles 18 will fall out from the concave contact surface while at the same time the mating contact surfaces 12*a*, 14*a* will wipe each other.

In a very dirty environment, it may happen that some particles 18 will still remain at the bottom of the concave surface 14*a* or become attached to the tip of the convex surface 12*a*, thereby tending to break electric continuity between the mating contact surfaces. Such a tendency is not easily detectable, and when detected erroneous seismic signals might have been already recorded by the seismic crew conducting the seismic survey and utilizing the connectors 9.

In accordance with a first aspect of the present invention, at the bottom of the concave surface 14*a* in the female contact 14 there is provided a linear groove 16 which is inclined at the same angle A as the concave surface 14*a*. Groove 16 allows for the sticky dirt particles 18 which do not fall out to become lodged therein. The opposite edges 16*a* of groove 16 scrape the convex surface 12*a*, thereby further ensuring proper electric conductivity between the mating contact surfaces.

In accordance with a second aspect of the invention, each electric contact (12 or 14) is made up of two parts: a head portion (12*b* or 14*b*) made of barillium copper and a rod portion 20 made of phosphor bronze, which is a hard material that does not easily bend. The inner end 20*a* of the rod is seized to become frictionally received within the head's bore (12*c* or 14*c*). The outer end 20*b* of rod 20 is flattened to provide an enlarged soldering surface 22.

It will be appreciated that the construction of the electric contacts 12, 14 in accordance with the present invention is considerably less expensive than the unitary contacts machined of barillium copper and described in my said patent. Additionally, the rods 20 are more rigid and are less subject to becoming bent.

In accordance with a third aspect of the present invention, the resilient base 16 in each plug is in contact with a rigid support 30 having an inner face 31 and a frosto-conical outer surface 32. Rods 20 are arranged in concentric rows and their lengths increase as one moves radially inwardly to the center of the plug. This arrangement facilitates the soldering process of wires to the flattened ends 22 of contacts 20.

A coil spring 40 is disposed on each conductor rod 20 between the end face (12*d* or 14*d*) of the contact head (12*b* or 14*b*) and the inner face 31 of the rigid support 30. The coil springs 40 are embedded within the elastic rubber base 16 and exert an outwardly-directed force on each contact surface, thereby reinforcing the contact pressure between the contact surfaces.

The springs 40 serve an additional function in that they tend to mechanically isolate the individual contacts 12 or 14 against their tendency to follow the motions of each other. Undesired movements by immediately adjacent contacts might adversely affect the operation of the connector.

What is claimed is:

1. In a seismic electric connector assembly comprising a pair of cooperable plug members wherein each plug member includes an elastically resilient insulator base in contact with a rigid support and a plurality of engageable male and female contacts embedded in opposed end faces of the resilient insulator bases with each male contact having a convex contact surface and each female contact having a concave contact surface for mating contact with a convex contact surface which laterally displaces the convex and concave contact surfaces to produce a wiping/cleaning of the surfaces, the invention characterized in that the concave contact surface includes a groove at the bottom thereof for accepting therein dirt particles which are not expelled from the concave contact surface by the wiping action between the contact surfaces and a coil spring embedded in the resilient base, said spring being disposed on the rigid base to support each male and female contact in the plug members and to exert an outwardly directed force on each contact surface.

* * * * *